United States Patent [19]

Elias et al.

[11] Patent Number: 4,577,996

[45] Date of Patent: Mar. 25, 1986

[54] METHOD OF CONTROLLING AQUATIC PLANT GROWTH AND SILICONE RUBBER BENTHIC BARRIERS

[75] Inventors: Michael G. Elias, Mayfield Heights, Ohio; George D. Pullman, Midland, Mich.

[73] Assignee: Dow Corning Corporation, Midland, Mich.

[21] Appl. No.: 628,942

[22] Filed: Jul. 10, 1984

[51] Int. Cl.[4] ..... E02B 3/00

[52] U.S. Cl. ..... 405/17; 47/9; 405/270; 428/266; 528/17

[58] Field of Search ..... 405/15–20, 405/258, 270; 47/9, 31; 528/17–23; 428/266, 268, 447

[56] References Cited

U.S. PATENT DOCUMENTS

| | | | |
|---|---|---|---|
| 3,151,463 | 10/1964 | Talbott | 405/52 |
| 3,769,747 | 11/1973 | Chapman | 47/31 |
| 4,056,936 | 11/1977 | Mayer | 47/31 X |
| 4,221,688 | 9/1980 | Johnson et al. | 528/18 X |
| 4,230,061 | 10/1980 | Roberts et al. | 428/266 X |
| 4,266,370 | 5/1981 | Kodera et al. | 47/9 X |
| 4,405,264 | 9/1983 | Brady et al. | 405/258 X |
| 4,481,242 | 11/1984 | Fletcher | 47/9 X |
| 4,518,280 | 5/1985 | Fletcher | 405/17 |

FOREIGN PATENT DOCUMENTS

| | | | |
|---|---|---|---|
| 0000207 | 1/1982 | Japan | 405/15 |

*Primary Examiner*—Dennis L. Taylor
*Attorney, Agent, or Firm*—Roger H. Borrousch

[57] ABSTRACT

Aquatic plant growth can be reduced or eliminated in a pond or lake by placing a silicone rubber-coated fabric over the area where such plants want to be eliminated.

4 Claims, No Drawings

METHOD OF CONTROLLING AQUATIC PLANT GROWTH AND SILICONE RUBBER BENTHIC BARRIERS

BACKGROUND OF THE INVENTION

Field of the Invention

This invention relates to a method of controlling aquatic plant growth and benthic barriers.

BACKGROUND INFORMATION

Most freshwater management plans include some degree of control or elimination of excessive aquatic plant growth. The impact of excessive plant growth on recreational resources and riparian property values is obvious and often devastating. Dense stands of hydrophytes can also harbor disease vectors, cause flooding, and waste tremendous volumes of valuable irrigation water. Perhaps the most common means of aquatic plant control has been the application of aquatic herbicides, but recent public opinion, rising costs, increasing regulations, and questions regarding the ecological implications of this strategy have stimulated the search for other management tools. The demand for innovative, truly integrative, and ecologically-founded aquatic weed controls is increasing.

The intentional and unintentional introduction of toxic substances into our water resources from a variety of sources has created a new and crucial area of concern for aquatic systems managers. Fortunately, some of these toxic substances are bound to particles in the hydrosoil and are buried by processes of sedimentation and, thereby, may never be a problem. However, too often these substances are cycled and recycled in a water body by both biological and chemical mechanisms and, thereby, remain a problem for extended periods of time. This can pose a severe threat to the health and economic stability of a community. Specialized controls are in great demand to alleviate the hazards created by such problems.

The use of benthic barriers (such as lake bottom covers) or sealants has been given considerable attention in recent years as direct and indirect means of aquatic plant control. Barriers and sealants have been used to inactivate, seal off, or bury the vast store of plant nutrients residing in some hydrosoils that may be largely responsible for nuisance aquatic weed and algae growth. Chemical compounds and "sheet-like" materials, such as polyethylene, have been used for this purpose with varying degrees of success. The physical barriers, i.e. polyethylene, polyvinylchloride, and nylon, can also be used to control rooted plant growth directly by forming a substrate, impenetrable by plant roots. Furthermore, physical barriers can also be placed over existing weed beds and, provided they are sufficiently opaque, negatively buoyant, and resistant to being buoyed up by bottom-generated gasses, can achieve immediate control of nuisance plant growth by shading and/or compression. Perhaps the greatest problem associated with this type of weed control is related to the vertical movement of gasses, i.e. $CO_2$, $H_2S$, and $CH_4$, generated beneath a barrier. Many of the materials that are sufficiently permeable by these gasses are generally too porous to be sufficiently opaque to control underlying plants by shading. For example, materials, such as black plastic sheets, can control nuisance plants by shading; however, they are relatively impenetrable to the gasses generated beneath them and are, thereby, buoyed up and floated at the water surface unless extraordinary measures are taken to assure that they remain in place. Common plastics, such as polyethylene, are also known to become brittle and may break apart in such applications. At any rate, most people would consider the floating plastic to be visually unacceptable and, consequently, their use appears to be limited as a means of submersed plant control.

Physical and chemical barriers might also be used to prevent the movement or recycling of toxic compounds from lake sediments in much the same manner that they prevent the movement of essential plant nutrients.

SUMMARY OF THE INVENTION

This invention relates to a method for controlling the growth of aquatic plants in a body of water which is exposed to sunlight comprising depositing on the surface of the body of water over the location where plant life is to be controlled, a benthic barrier which comprises a fabric coated on at least one side with silicone rubber thick enough to prevent root penetration and thin enough to allow gases forming below the barrier to pass through the coating and escape, said silicone rubber comprising crosslinked polyorganosiloxane and filler which blocks the passage of light through the barrier to the bottom of the body of water and raises the specific gravity above 1.0 to a value which allows the barrier to readily settle to the bottom where it covers the aquatic plants or the bottom on which aquatic plant growth is to be prohibited, after the barrier is placed on the water surface, it settles to the bottom and is anchored as necessary to avoid displacement by turbulence in the body of water.

This invention relates to a benthic barrier comprising a fabric coated on at least one side with silicone rubber which has a film thick enough to prevent root penetration and thin enough to allow gases forming below the barrier to pass through and escape from a body of water, said silicone rubber comprises crosslinked polyorganosiloxane and filler which blocks the passage of light through the barrier to the bottom of a body of water and raises the specific gravity above 1.0 to a value which allows the barrier to readily settle in a body of water, said barrier prohibits and inhibits the growth of aquatic plants.

DETAILED DESCRIPTION OF THE INVENTION

A benthic barrier made by coating at least one side of a fabric with silicone rubber is placed on the surface of a body of water in a location where needed. The need can be the reduction or elimination of aquatic plants, the entrapment of substances on the bottom, for example, toxic substances, and the prevention of aquatic plant growth. The benthic barrier is placed on the water surface and it settles to the bottom. Although the barrier can be forced to the bottom, one unique feature of this method is that it readily settles without the use of force. After the barrier settles to the bottom, it can be anchored by a number of means, such as with rocks or stakes. Anchoring would not be necessary, if the body of water would not experience turbulence. However, if turbulence is likely, the barrier should be anchored.

In the method for controlling aquatic plant growth, the kind of benthic barrier used in the presence invention has many advantages over other benthic barriers. The benthic barrier of the present invention comprises a silicone rubber coating on at least one side of a fabric. Although the fabric may be coated on both sides or fuly impregnated, it is preferably to coat only one side because silicone rubber would be expensive, no benefit would be expected, and reduction in applicability is likely. Benthic barriers which have silicone rubber on only one side, preferably have the rubber side up, i.e. the rubber side of the barrier is toward the water surface. Having the fibrous side up would permit plant growth to attach more readily to the barrier because the roots can tangle with the fibers of the fabric. Having the fibrous side up would also present more difficulty when there was a need to clean the barrier. Barriers with the silicone rubber side up are readily cleanable because plant growth does readily not attach. Because the benthic barrier of the present invention is readily cleanable, it can remain in place for more than one year without cleaning. The barrier may not require cleaning for several years. The nature of the body of water would be a determining factor in how often cleaning is needed, for example, how much sediment and debris settles on the barrier.

The fabric can be woven or unwoven, preferably unwoven. The fabric is preferably made from a material which is resistant to the environment of lakes, ponds, streams, rivers, and the like. Such a material is polypropylene fibers in a nonwoven mat. The fabric is coated with silicone rubber composition which comprises polyorgano-siloxane and a filler. The composition is cured by cross-linking the polyorganosiloxane. The silicone rubber composition is coated on the fabric to provide a silicone rubber film thick enough to prevent root penetration through the barrier. A thickness which provides a substantially continuous film which does not have many pinholes is usually sufficient. The silicone rubber film is also thin enough to allow bottom gases to pass through the barrier without buoying the barrier toward the surface and up to and including raising it to the surface where it may interfere with the activity on or in the body of water, such as getting tangled in a boat motor propeller or where it may not perform its function as a barrier to eliminate and prevent aquatic plant growth. The benthic barrier of this invention does allow bottom generated gases to pass through the membrane, however, placing the barrier over an area having dense and vigorous plant growth or microorganism concentrations may initially result in very rapid generation of bottom gases. When such rapid gas generations occur, the barrier may not allow the gas to penetrate as rapidly as it is formed and the barriers may be buoyed at certain places for a short time, but in a reasonable time, such as a few days to one or two weeks, the gas will penetrate the barrier and the barrier will again settle to the bottom.

The filler in the silicone rubber is one which blocks the passage of light through the barrier but still allows the gases to pass through. These fillers include silica, fumed silica, calcium carbonate, crushed quartz, titanium dioxide, carbon black, and colloidal silica. The filler also is present in a concentration sufficient to raise the density of the barrier above a specific gravity of 1.0 and to a value which allows the barrier to readily settle to the bottom of the body of water. It is to be understood that the aquatic plant growth may support the barrier above the soil bottom of the body of water, and when discussed herein that the barrier settles to the bottom, the bottom may be where the barrier settles on the aquatic plant growth.

It is expected that the kind of silicone rubber is not critical if the above described characteristics are present. One particularly useful kind of silicone rubber film is made by coating the fabric with a latex comprising an anionically stabilized polydimethylsiloxane, colloidal silica, light blocking filler and pigments, and water where the latex has a pH of from 9 to 11.5. This latex is known and is described in U.S. Pat. No. 4,221,688, issued Sept. 9, 1980 to Johnson et al. which is hereby incorporated by reference to described the latex.

The benthic barriers of this invention can be used to control undesirable sediment on the bottom of a body of water by holding them in place and not allowing them to be mixed in the overlying water column. The silicone rubber film of the benthic barrier can contain antimicrobial agent or biocide or other agents to alter the structure or function of the aquatic ecosystem or ameliorate the impact of pollution phenomenon.

For the direct control of submersed rooted aquatic plants, the silicone rubber benthic barrier can be placed over existing aquatic plant beds. The barrier attenuates light penetration to a point below a plant's inherent light compensation point or, more simply stated, it shades out the plants. Additionally, some plants are controlled by compressing them to the sediment surface with the barrier. Gases released by the decomposing plants and generated in the pond sediments are able to escape through the silicone rubber benthic barrier due to its diffusivity characteristics. As the plants decompose and collapse, the barrier settles to the bottom of the system and serves as a barrier to further aquatic plant growth or future infestation.

The silicone rubber benthic barriers are expected to be useful in preventing the movement, or impeding the cycling, of undesirable chemical compounds from lake sediments to the water column. The barrier is impermeable to these undesirable chemical compounds but allows gasses to pass freely. If the gasses released by the bacterial metabolism of rich lake sediments were trapped beneath the barrier, the barrier could be floated out of position. The silicone rubber benthic barrier is expected to be ideal for use as a lake bottom barrier to chemical compound release. Each kind of silicone rubber benthic barrier should be tested for its permeability to phosphorus, toxic compounds, and lake sediment gas releases, to ensure the most effective barrier for a given body of water.

The following example is presented for illustrative purposes only and should not be considered as limiting the invention which is properly delineated in the claims.

EXAMPLE

Test Results of the Use of Silicone Rubber Benthic Barriers for the Control of *Elodea canadensis* Michx.

Several sheets of benthic barrier made from silicone rubber latex coated on a non-woven polypropylene fabric, were deployed over a dense, vigorous bed of *Elodea canadensis* Michx. in a pond system. The silicone rubber latex was a anionically stabilized polydimethylsiloxane, colloidal silica, calcium carbonate, titanium dioxide, carbon black, and water at a pH of about 10.5. Various combinations of thick and thin fabrics and heavy and light silicone rubber coats made the silicone rubber benthic barrier membranes sink rapidly, facilitating immediate control of excessive weed growth. The sheets, each about 15 feet by 40 feet, were fastened to the pond bottom with wire stakes and weighed down elsewhere with fewer than 10 rocks per sheet, each rock measuring less than 16 cm in diameter and weighing approximately 0.5 to 1.5 kg. The thick fabric, heavy silicone rubber-coated benthic barrier membrane became slightly buoyant several days following replacement. The thin fabric, lightly silicone rubber-coated benthic barrier membrane showed little buoyant tendency and retained excellent contact with the pond bottom for the duration of the test.

Previous studies have revealed a tendency for benthic barriers to become less permeable to benthic generated gasses as they become covered with attached algal growths. These algal growths have been described by researchers as complex communities and are commonly referred to as algal-muco-organic-complexes. The silicone rubber benthic barrier membranes showed less tendency for the algal growth and attachment of that growth to the membrane than other benthic barriers.

That which is claimed is:

1. A method for controlling the growth of aquatic plants in a body of water which is exposed to sunlight comprising depositing on the surface of the body of water over the location where plant life is to be controlled, a benthic barrier which comprises a fabric coated on at least one side with silicone rubber thick enough to prevent root penetration and thin enough to allow gases forming below the barrier to pass through the coating and escape, said silicone rubber comprising crosslinked polyorganosiloxane and filler which blocks the passage of light through the barrier to the bottom of the body of water and raises the specific gravity above 1.0 to a value which allows the barrier to readily settle to the bottom where it covers the aquatic plants or the bottom on which aquatic plant growth is to be prohibited, after the barrier is placed on the water surface, it settles to the bottom and is anchored as necessary to avoid displacement by turbulence in the body of water.

2. The method in accordance with claim 1 in which the silicone rubber is made by depositing on the fabric a latex comprising an anionically stabilized polydimethylsiloxane, colloidal silica, light blocking filler and pigments, and water where said latex has a pH of 9 to 11.5 and removing the water.

3. A benthic barrier comprising a fabric coated on at least one side with silicone rubber which has a film thick enough to prevent root penetration and thin enough to allow gases forming below the barrier to pass through and escape from a body of water, said silicone rubber comprises crosslinked polyorganosiloxane and filler which blocks the passage of light through the barrier to the bottom of a body of water and raises the specific gravity above 1.0 to a value which allows the barrier to readily settle in a body of water, said barrier prohibits and inhibits the growth of aquatic plants.

4. The benthic barrier according to claim 3 in which the silicone rubber is made by depositing on the fabric a latex comprising an anionically stabilized polydimethylsiloxane, colloidal silica, light blocking filler and pigments, and water, where said latex has a pH of 9 to 11.5 and removing the water.

* * * * *